United States Patent [19]

Smith

[11] 4,005,793

[45] Feb. 1, 1977

[54] RAM FOR LIFT TRUCK

[75] Inventor: Robert L. Smith, Westland, Mich.

[73] Assignee: Kasle Steel Corporation, Detroit, Mich.

[22] Filed: Oct. 10, 1975

[21] Appl. No.: 621,438

[52] U.S. Cl. ..... 214/620; 214/750; 214/DIG. 4

[51] Int. Cl.[2] ..... B66F 9/12

[58] Field of Search ..... 214/130 C, 145 A, 372, 214/620, 621, 651, 750, DIG. 1, DIG. 3, DIG. 4

[56] References Cited

UNITED STATES PATENTS

| | | | |
|---|---|---|---|
| 1,626,555 | 4/1927 | Remde | 214/750 |
| 2,386,759 | 10/1945 | Ulm | 214/620 |
| 2,545,417 | 3/1951 | Ulinski | 214/750 X |
| 2,684,164 | 7/1954 | Violette | 214/620 |
| 3,480,167 | 11/1969 | Varilek | 214/620 |
| 3,825,139 | 7/1974 | Geis | 214/750 X |

*Primary Examiner*—L. J. Paperner
*Attorney, Agent, or Firm*—Cullen, Settle, Sloman & Cantor

[57] ABSTRACT

A ram attachment for a lift truck, the ram for engaging and lifting coiled stock, spools and the like the ram including a flat plate of a generally U-shaped configuration including a horizontal base and two upwarding extending spaced apart legs, the legs for mounting the ram on the conventional rectangular carriage frame of a lift truck, and an elongated bar extending outwardly from the horizontal base for engaging the center of the coiled stock with the legs of the plate being spaced apart horizontally so that the ram is mounted outwardly of the conventional vertically driven hanger or frame of the lift truck so that the ram does not obstruct the vision of the operator of the lift truck.

7 Claims, 6 Drawing Figures

FIG. 1
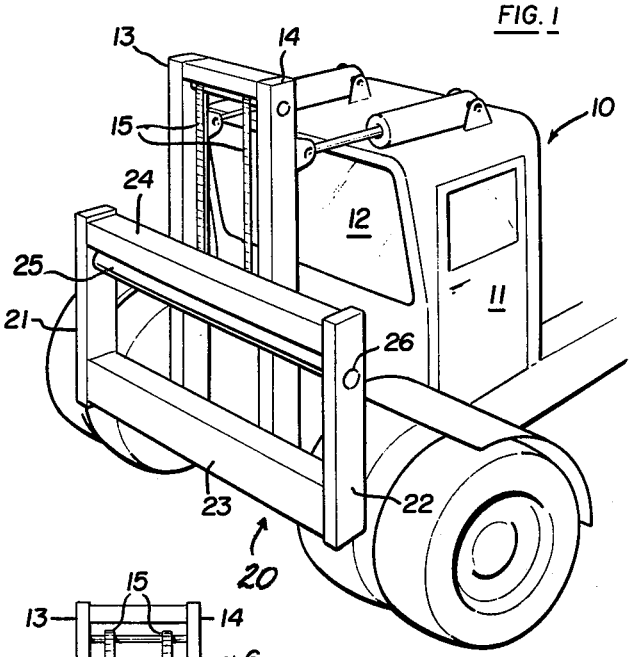
FIG. 2
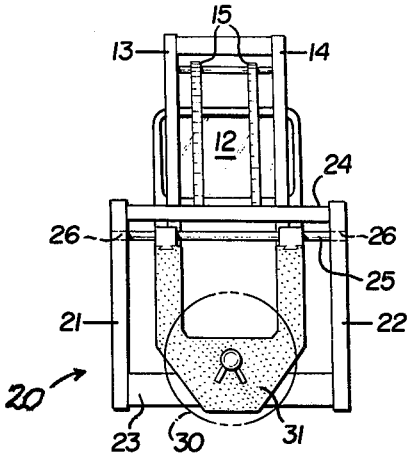
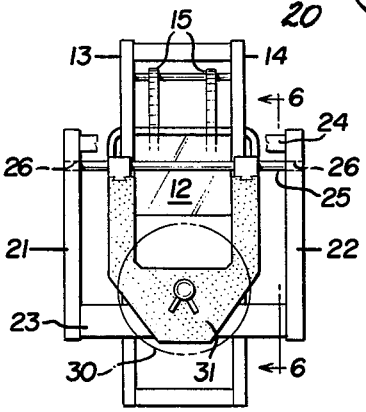
FIG. 3
FIG. 4
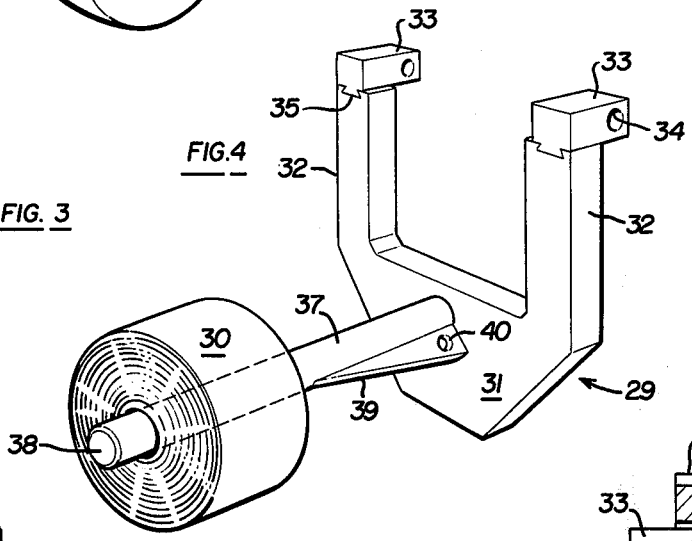
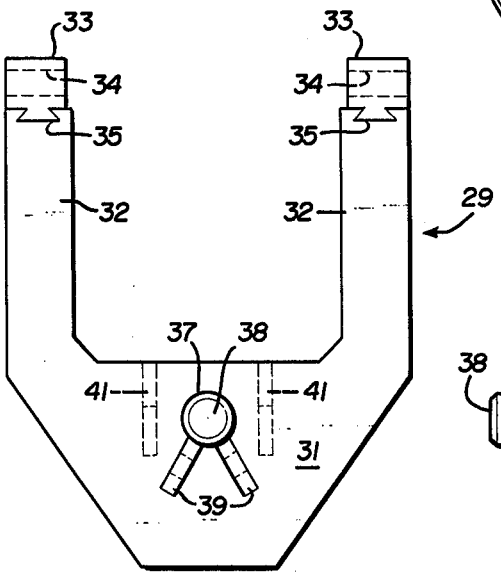
FIG. 5
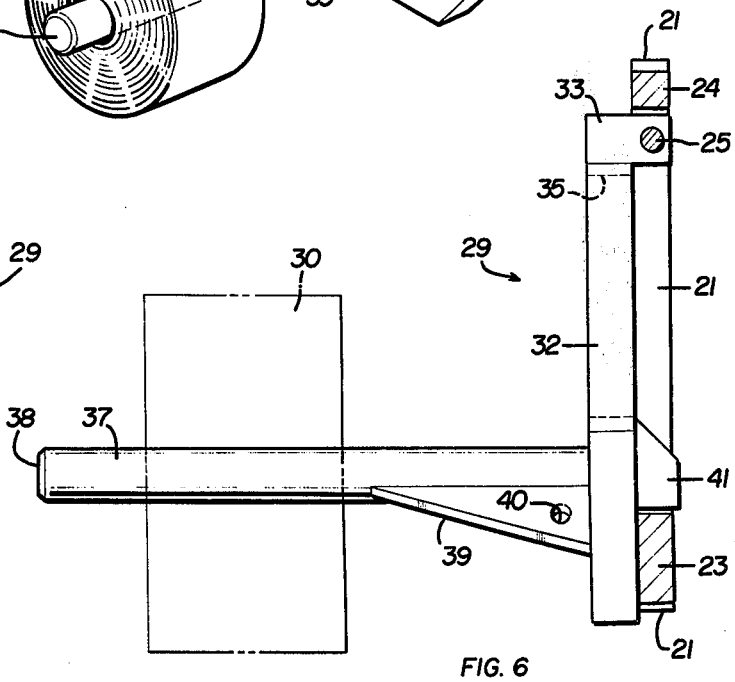
FIG. 6

RAM FOR LIFT TRUCK

BACKGROUND OF THE INVENTION

This invention relates generally to a ram attachment for a lift truck to enable the ram to engage and lift coiled stock, spools and the like, all of which have a hollow center.

Lift trucks or hi-lo trucks are commonly used in industrial applications. One common use of these trucks, when they are fitted with a fork attachment, is the lifting and moving of pallets. For this reason, the lift trucks are often called fork-lift trucks. The fort lift attachment is "L" shaped including a vertical member and an outwardly extending horizontal member attached to the bottom of the vertical member.

When lift trucks are equipped with two fork-lift attachments, they are unsatisfactory for lifting coiled stock. This is because it is necessary to move the fork attachments next to each other in front of the truck so that the prongs are together when they enter the hollow center of the stock. When this is done and the stock is lifted, the vertical members of the fork-lift attachment obstructs the vision of the operator of the lift truck. Even if one fork lift attachment was removed and the other utilized to lift the coiled stock, the vertical member still obstructed the operator's vision.

Several solutions to the problem of obstructed vision have been attempted in the past. A first attempt was to equip the truck with outwardly extending mirrors attached at an angle so that the operator of the truck could look into the mirrors and see in front of the truck. This solution, however, required the operator of the lift truck to be looking both straight ahead and at the mirrors when the coil stock was being lifted and subsequently lowered and, hence, was not satisfactory as it required the operator of the lift truck to constantly turn his head to look both straight ahead and into the mirror thus interrupting the concentration of the operator of the truck. Also, the mirrors are impractical when the lift truck is used outdoors in inclement weather.

To overcome this problem, a second solution was to utilize two persons in the cab of the lift truck. The first person would operate the lift truck and the second person would be required to dismount from the lift truck and direct the truck operator from a position on the ground where the second person could observe the coil stock and simultaneously be observed by the truck operator. This, of course, increased the cost of operation of the equipment.

Since these solutions are not satisfactory, the present invention provides a ram attachment for a lift truck to engage and lift coiled stock without obstructing the vision of the operator of the lift truck.

SUMMARY OF THE INVENTION

Thus the invention herein relates to an improved ram attachment for a lift truck, the ram attachment for entering the center of coiled stocks for lifting the same with the ram attachment not obstructing the vision of the operator of the lift truck.

More specifically, the present invention includes a plate having a generally U-shaped configuration including a horizontal base and two upwarding extending spaced apart legs, the legs for mounting the ram attachment on a conventional rectangular carriage frame of a lift truck. The ram attachment includes an elongated bar extending outwardly from the horizontal base for engaging the center of the coiled stock and the legs of the plate are spaced apart sufficiently far so that they do not obstruct the vision of the operator of the lift truck.

A mounting block or extension block is attached to the upper end of each leg, both by a mechanical interlock, i.e., tongue and groove and by welding and the block has an aperture therethrough to receive the conventional rectangular carriage frame of the lift truck.

In order to both reinforce the attachment and distribute the weight, a pair of gussets are welded to the bar and to the front of horizontal base plate and a pair of hip blocks are welded on the opposite side of the plate with the hip blocks bearing on the lower portion of the carriage frame.

BRIEF DESCRIPTION OF THE DRAWINGS

The various objects and advantages of the present invention may be more fully understood upon reading the following detailed description of the invention taken in conjunction with the drawings.

In the drawings, where like numerals identify corresponding elements:

FIG. 1 is a perspective illustration of a conventional lift truck including the vertically driven hangers and the rectangular carriage frame mounted on the hangers;

FIG. 2 is a front elevation of the lift truck of the present invention with the ram attachment mounted thereon and illustrating the lifting mechanism in its lower-most position;

FIG. 3 is a front elevation view of the lift truck having the ram attachment mounted thereon with the apparatus in an elevated position illustrating that the view of the operator of the lift truck has not been obstructed;

FIG. 4 is a perspective illustration of the ram attachment of the present invention with the coiled stock mounted thereon;

FIG. 5 is a front elevation of the ram attachment of the present invention; and

FIG. 6 is a side elevation view of the ram attachment of the present invention mounted on the rectangular carriage as seen in the plane of arrows 6—6 of FIG. 3 with the lift truck cab and hangers removed for clarity.

DETAILED DESCRIPTION OF THE INVENTION

To facilitate understanding the present invention, certain conventional portions of a lift truck 10 will be identified including the cab 11 having a front window 12 and a pair of spaced apart generally rectangular parallel hangers 13, 14 which are driven by a chain or belt drive 15. Movement of the chain 15, of course, raises or lowers the hangers 13,14.

Mounted on the front of the vertical hangers 13,14 is a generally rectangular carriage frame 20 including parallel spaced apart vertical carriage frame members 21,22, and upper and lower horizontal carriage frame members 23,24. In order to permit a work-engaging member to be attached to the lift truck 10 of the present invention, whether the work-engaging member be a conventional fork or the ram of the present invention, a bar 25 of generally circular cross section is journalled in suitable apertures 26 in the vertical frame members 21 and 22 so that the bar 25 extends horizontally just below the upper horizontal carriage frame member. This explains the basic structure of the lift truck as it relates to the present invention.

In order to engage and maneuver coiled stock, the present invention includes a ram 29 illustrated in FIGS. 2, 3, 4 and 6 as engaging the hollow center of coiled stock 30. The coiled stock may be coiled metal, wire, spools or the like.

The ram of the present invention includes a plate having a generally U-shaped configuration including a horizontal base 31 and two parallel spaced apart vertical legs 32 extending upwardly from the horizontal base plate 31. In order to mount the ram onto the rectangular carriage frame 20, the ram includes a pair of extension or mounting blocks 33, each being slightly narrower, from side to side, than the legs 32 of the plate and each being deeper, from front to back, than the thickness of the plate. An aperture 34 is journalled in each mounting block 33 to receive the bar 25 therethrough. As illustrated in greater detail in FIG. 6, the aperture 25 is offset rearwardly behind the vertical plane of the plate. The mounting blocks themselves are mechanically interlocked, such as by tongue and groove 35, to the top of the legs 32 and, in addition, may be welded to the legs 32 for increased strength.

In order to engage the coiled stock, the ram of the present invention includes an elongated bar 37 of generally circular cross section having a first end attached to the horizontal base 31 of the plate and having its free end extending away from the lift truck 10 and chamferred as at 38. During fabrication, the bar 37 may be welded to the plate 31 and, in addition, to increase the strength of the ram, a pair of gussets 39 may be welded to both the front of the horizontal base plate 31 and the bar 37. Each gusset has an aperture 40 therethrough corresponding generally in location to the center of gravity of the entire ram for use in installation.

Since, as may be appreciated, the lift truck of the present invention can be expected to lift heavy coiled stock, in addition to the welding reinforcement of the gussets 39, a pair of hip blocks 41 are welded on the back of the base plate 31 and extend rearwardly therefrom toward the rectangular carriage frame 20. Each of the hip blocks is positioned to rest on the top of the lower horizontal member of the rectangular carriage frame 20 and thus distributes the weight back to the carriage frame from the bar 37.

Having thus described the structure of the present invention, the method of fabrication and attachment to the carriage frame will be explained. Starting with the structure of FIG. 1, the bar 25 is withdrawn from one of the two vertical members 21,22, the extension blocks 33 are mounted thereon by extending the bar through the apertures 34 in each extension block, and then the bar 25 is returned into the aperture 26 in the vertical carriage frame member.

Next, a crane or other hoist is utilized to lift the ram 29 and for this purpose, the holes 40 in the gussets 39 are located at approximately the center of gravity of the ram. The ram is lifted up and slid onto the mounting blocks 33 to interlock the tongue and groove with the tongue 35 of each extension or mounting block engaging the corresponding groove at the top of each leg 32. Then, the entire ram is rotated slightly about the bar 25 until the hip blocks 41 rest on top of the horizontal frame member 23. Thereafter, the extension or mounting blocks 33 may be welded to the legs 32.

As an alternate method of mounting the ram 29 of the present invention to the lift truck carriage frame 20, the extension blocks 33 may initially be interlocked and welded to the legs 32. Thereafter, with the bar 25 withdrawn from one of the vertical frame members, the entire ram 29 may be hoisted upwardly by a cable or the like and the bar 25 slid through the apertures 34 in each mounting block 33.

As previously indicated, it is important that the present invention not obstruct the vision of the operator of the lift truck. For this reason, it is critical that the legs 32 be spaced apart a sufficient distance to avoid obstructing the vision of the operator of the lift truck as seen through the window 12. Thus, in the preferred embodiment, the legs 32 extend outwardly of the vertical hangers 13,14. Thus, as shown in both FIGS. 2 and 3, the lower and upper extreme positions of the lift truck, the legs 32 do not obstruct the vision of the operator of the lift truck.

In a preferred embodiment, the vertical legs 32 of the ram are spaced 36 inches apart (interior dimensions) and the overall side to side widths of the ram is 54 inches. The height of the ram is 60 inches and the extension blocks 33 add an additional 6 inches in height to the legs. The plate 31 and legs 32 are 6 inches thick, front to back, and the extension blocks 33 are 10 inches thick, front to back, to allow the apertures 34 to be offset relative to the vertical plane of the U-shaped plate. The hip blocks extend backwardly a distance of about 5 inches from the rear face of the base plate 31. The plate is fabricated of hot rolled steel.

The ram bar 37, preferably of circular cross section, is of a length and diameter commensurate with the capacity required to handle the particular workload or stock. For example, a bar of a 7 inch diameter and just over six feet in length, and fabricated of cold rolled steel, has proven to be satisfactory in industrial applications.

The foregoing description of the invention, together with the exemplary dimensions of the ram of the present invention, should not be construed in a restrictive sence, but only as describing the underlying concepts of the present invention. The invention should be limited only by the scope of the following claims.

What is claimed is:

1. In a lift truck of the type having a cab, a pair of vertically driven, parallel, spaced apart hangers mounted in front of the cab and a generally rectangular carriage mounted on the front of the hangers to move therewith, the improvement of a ram for engaging and lifting coiled stock, spools or the like comprising:

a plate having a generally U-shaped configuration including a horizontal base and two upwardly extending spaced apart legs;

said legs for mounting said ram on said rectangular carriage frame; and an elongated bar extending from said horizontal plate base outwardly away from said rectangular frame for engaging the center of coiled stock;

said legs of said ram plate being spaced apart horizontally to be mounted outwardly of said hangers so that upon engaging stock and lifting the stock by vertically driving said hangers, the stock may be observed from the cab without the legs of said ram obstructing the view of said stock therefrom, and an extension block for each plate leg, each extension block having a hole journalled therethrough to receive the upper horizontal carriage frame member;

each extension block and its corresponding plate leg including a tongue and groove so that after suspending the extension blocks from said carriage frame, the U-shaped plate and ram may be lifted and slid onto the extension blocks with the plate legs and extension blocks mechanically interlocked by said tongues and grooves.

2. The invention as defined in claim 1, wherein said elongated bar has a circular cross section.

3. The invention as defined in claim 1, and further including a pair of gussets each attached to said elongated bar and each attached to the front of said horizontal plate base for reinforcing the elongated bar.

4. The invention as defined in claim 1, wherein said rectangular carriage frame has upper and lower horizontal members, and wherein said two upwardly extending spaced apart plate legs are suspended from said upper horizontal member of said carriage frame.

5. The invention as defined in claim 4, wherein said plate legs have holes journalled therethrough to receive the upper horizontal frame member therein so that said ram is suspended from the upper horizontal carriage frame member.

6. The invention as defined in claim 4, and further including a pair of hip blocks each secured to the rear face of said horizontal plate base and extending rearwardly therefrom for bearing on the lower horizontal carriage frame member to distribute the weight of said stock onto said carriage frame.

7. The invention as defined in claim 1, wherein each of said extension blocks extends above the plate legs and each of said extension blocks is thicker than the thickness of said plate to extend behind the plate towards the carriage frame so that upon mounting the ram onto the rectangular carriage frame, the ram is offset forward of the carriage frame.

* * * * *